US006757402B2

(12) United States Patent
Chan

(10) Patent No.: US 6,757,402 B2
(45) Date of Patent: Jun. 29, 2004

(54) KNOCKDOWN SPEAKER

(76) Inventor: Yen-Chen Chan, No. 120, Min An East Road, Hsin Chuang City, Taipei Hsien (TW)

( * ) Notice: Subject to any disclaimer, the term of this patent is extended or adjusted under 35 U.S.C. 154(b) by 280 days.

(21) Appl. No.: 09/987,300

(22) Filed: Nov. 14, 2001

(65) Prior Publication Data

US 2003/0091202 A1 May 15, 2003

(51) Int. Cl.[7] ..... H04R 25/00
(52) U.S. Cl. ..... 381/396; 381/407; 381/433
(58) Field of Search ..... 381/396, 397, 381/398, 407, 403, 412, 420, 433, 404; 29/594; 181/171, 172

(56) References Cited

U.S. PATENT DOCUMENTS 5,940,522 A * 8/1999 Cahill et al. ..... 381/397
6,219,431 B1 * 4/2001 Proni ..... 381/397

* cited by examiner

*Primary Examiner*—Huyen Le
(74) *Attorney, Agent, or Firm*—Bacon & Thomas, PLLC

(57) ABSTRACT

A knockdown speaker. The speaker includes a magnetic circuit base, a casing, and a vibration unit. The magnetic circuit base is substantially a hollow body having a central projecting cylinder and fixing holes in its top rim. The vibration unit is composed of a funnel-shaped cone socket and a damper set, which are formed by combining a bottom end and a top end of the vibration unit respectively with a sound ring set or a piece of drum paper. The magnetic circuit base is mounted on the bottom rim of the casing. The vibration unit is jointed with the magnetic circuit base via the sound ring set arranged at the bottom end of the vibration unit to form a consolidated knockdown speaker.

2 Claims, 4 Drawing Sheets

KNOCKDOWN SPEAKER

FIELD OF THE INVENTION

This invention relates generally to a speaker, particularly to a knockdown speaker for facilitating parts replacement and for saving a user's cost.

BACKGROUND OF THE INVENTION

Almost all kinds of the existing speakers so far are sold by an entire unit, that is, every speaker is a basic unit, so that one usually can not secure parts of speaker for replacement when a breakdown is encountered because no such speaker parts are available, instead, he has to pay more for a new speaker.

Moreover, as the music fans are readily to revise the sound effect of their phonographic equipments from time to time for excitement, a knockdown speaker could be something making a great hit with them by merely changing a vibration part or a magnetic circuit, etc.

SUMMARY OF THE INVENTION

In order to improve the defects mentioned, this invention is to provide a knockdown speaker, which can be mounted or dismounted easily, so that assembly job can be significantly simplified and parts resources can be integrated effectively for easy replacement and for cost saving.

To achieve abovesaid targets, the knockdown speaker of this invention mainly comprises a magnetic circuit base, a casing, and a vibration unit. The magnetic circuit base is substantially a hollow body having a projecting cylinder at center and a plurality of fixing holes in its top rim. The vibration unit is composed of a funnel-like cone socket and a damper set, which are formed by combining a bottom end and a top end of the vibration unit respectively with a sound ring set or a piece of drum paper. The magnetic circuit base is mounted on the bottom rim of the casing, then the vibration unit is jointed with the magnetic circuit base via the sound ring set arranged at the bottom end of the vibration unit to form a consolidated knockdown speaker.

For more detailed information regarding advantages or features of this invention, at least an example of preferred embodiment will be elucidated below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
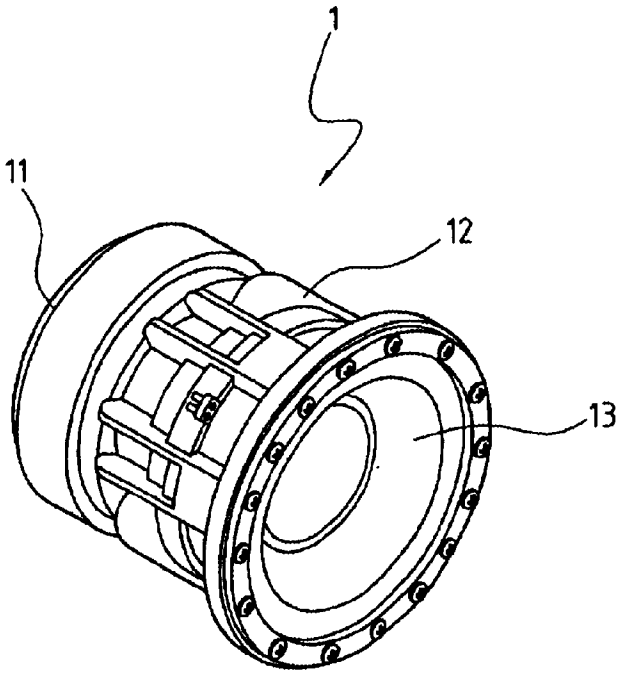
FIG. 1 is a perspective view of this invention.
Figure 2:
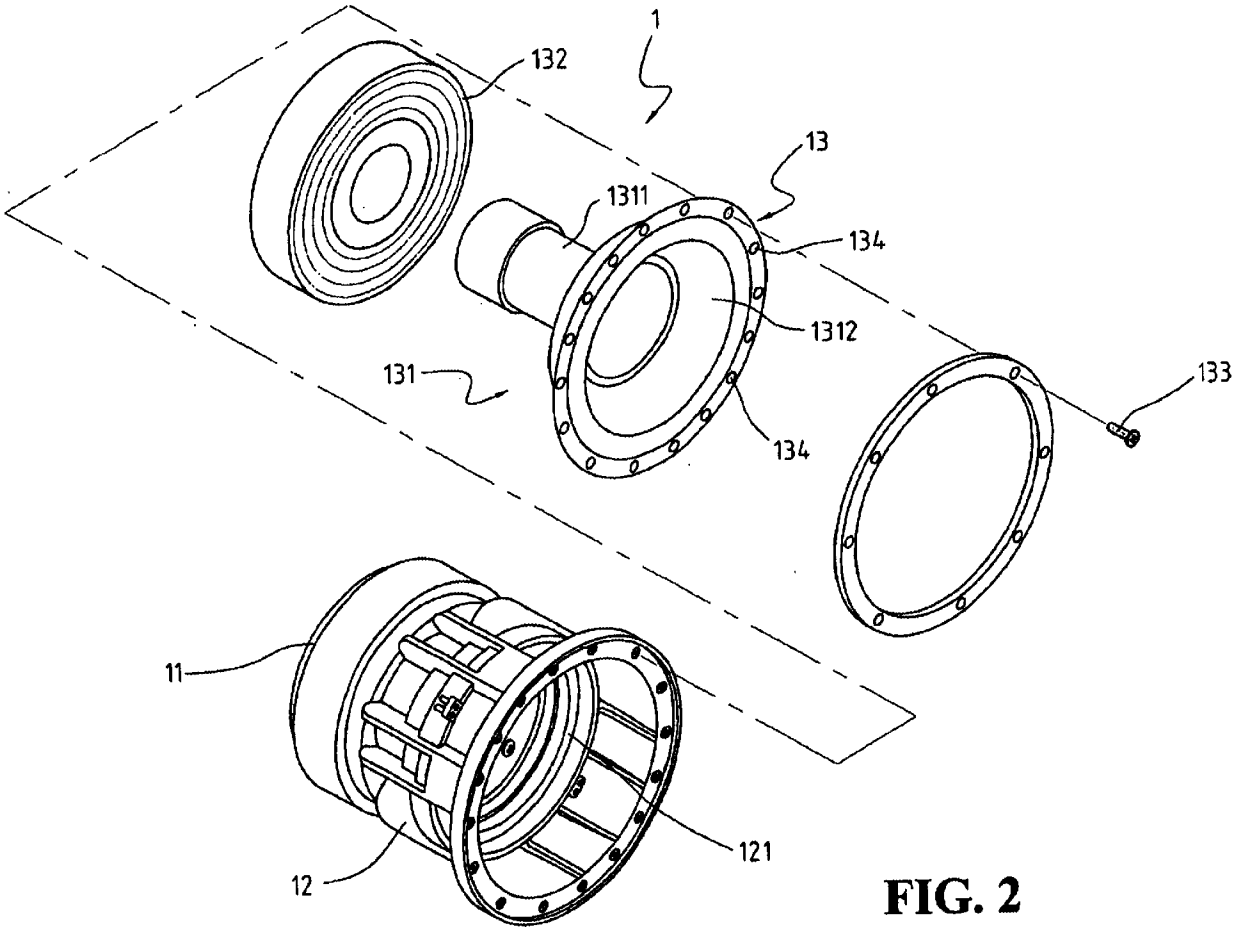
FIG. 2 is an exploded view (1) of this invention in three dimensions.
Figure 3:
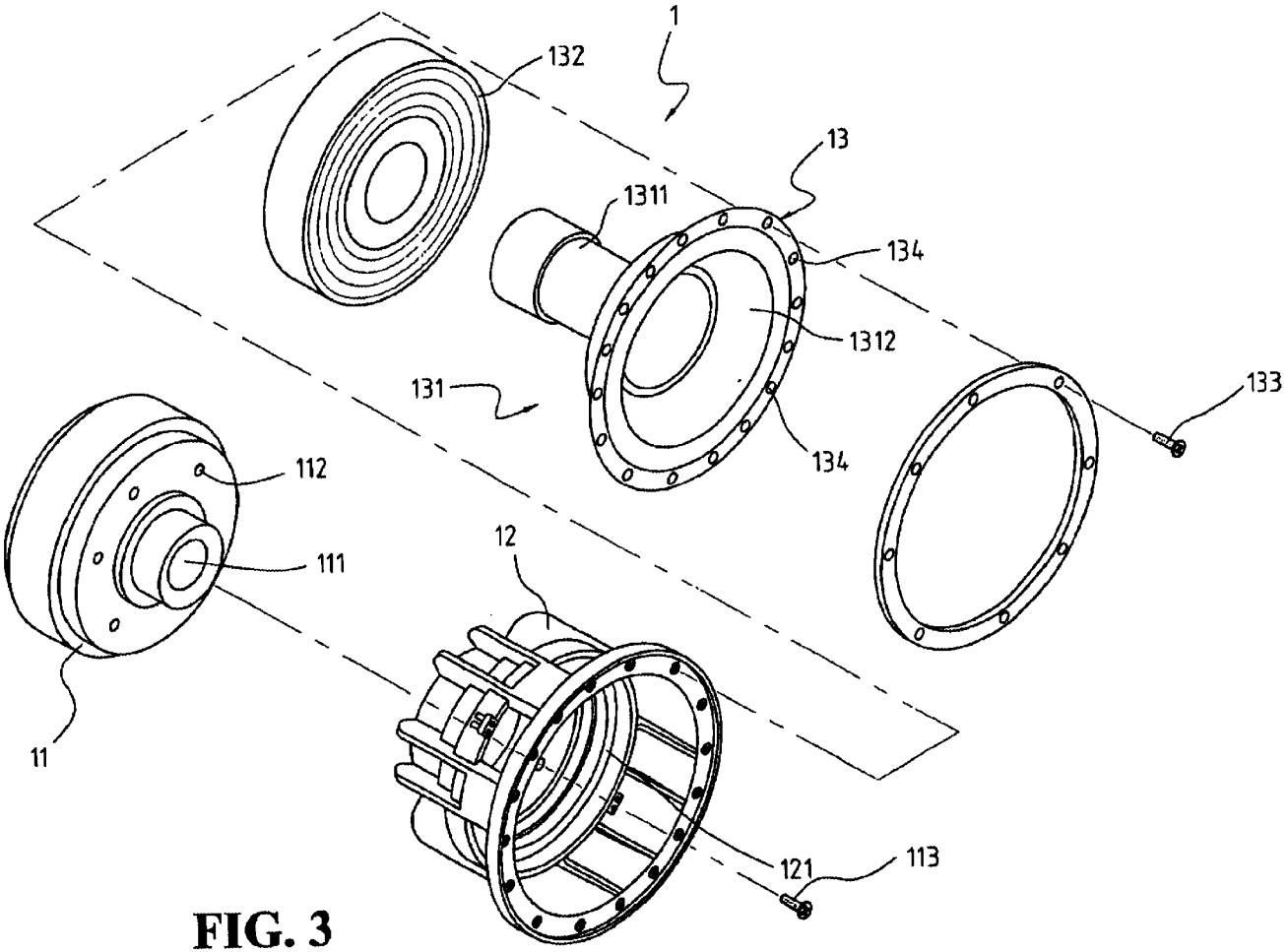
FIG. 3 is another exploded view (2) of this invention in three dimensions.

As shown in FIGS. 1, 2, and 3, a knockdown speaker of this invention mainly comprises a magnetic circuit base 11, a casing 12, and a vibration unit 13.

The magnetic circuit base 11 is substantially a hollow body having a projecting cylinder 111 at a center thereof and a plurality of fixing holes 12 in its top rim, wherein a plurality of setting elements 113 (preferably screws) corresponding with the fixing holes 112 are applied to set the magnetic circuit base 11 to a top rim of the casing 12 such that the centerline of both the projecting cylinder 11 and the casing 12 are coaxial.

The vibration unit 13 is composed of a funnel-shaped cone socket 131 and a damper set 132, which are formed by combining a bottom end and a top end of the vibration unit respectively with a sound ring set 1311 or a piece of drum paper 1312. After the magnetic circuit base 11 has been placed and fixed at one end of the casing 12, the sound ring set 1311 at the bottom end of the cone socket 131 is plugged in the projecting cylinder 111 at the center of the magnetic circuit base 11 such that the vibration unit 13 is coupled to the magnetic circuit base 11. Finally, by using a plurality of setting elements 133 and a plurality of mated fixing holes 134 in the bottom rim of the vibration unit 13, the vibration unit 13 is combined together with the casing 12 to form an integral speaker 1.

Figure 4:
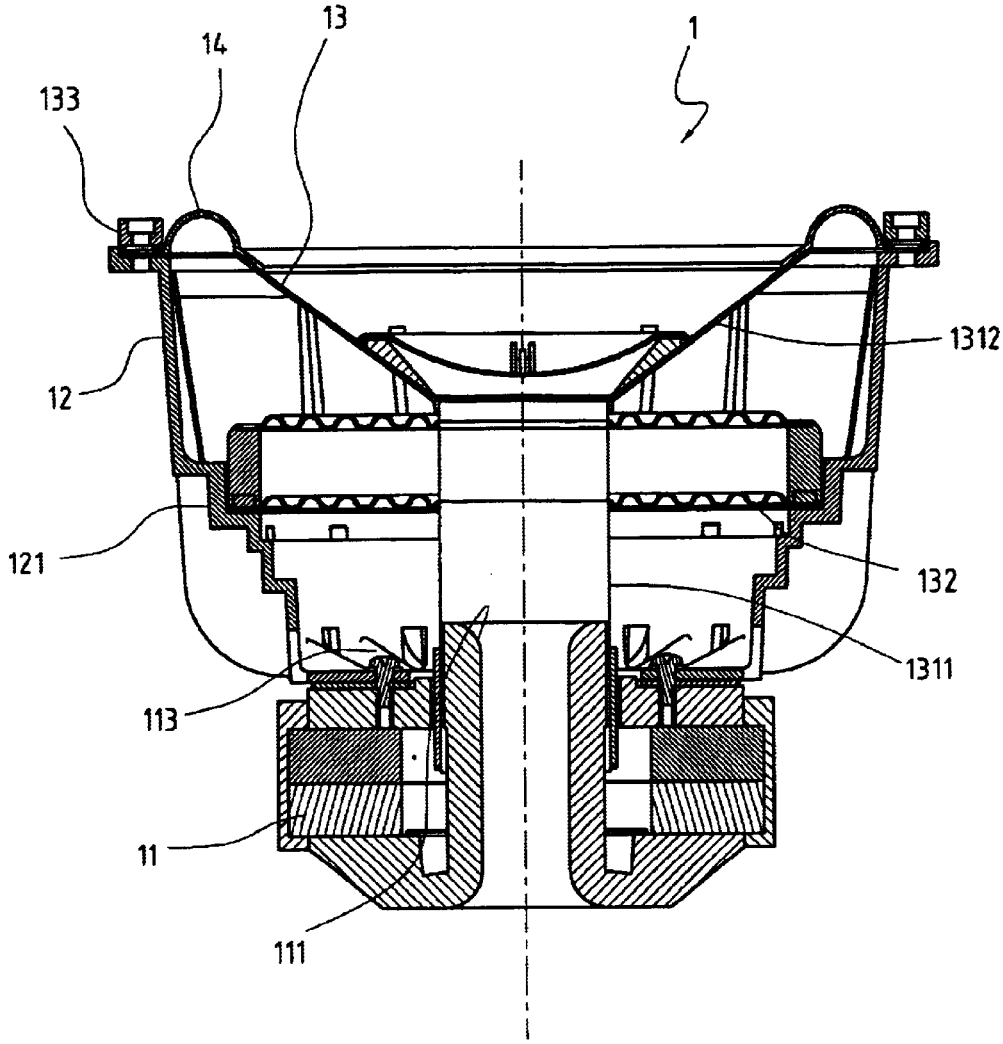
FIG. 4 is a cutaway sectional view of this invention.

According to a cutaway sectional view shown in FIG. 4, the magnetic circuit base 11 is shown mounted on the bottom rim of the casing 12, then the vibration unit 13 is jointed with the magnetic circuit base 11 via the sound ring set 1311 arranged at the bottom end of the vibration unit 13. The damper set 132, either in one-layer or two-layer formation, is mounted on the outer circumferential surface of the sound ring set 1311 of the vibration unit 13 and supported meanwhile by a preformed stepping seat 121 inside the casing 12. Finally, after the magnetic circuit base 11 and the vibration unit 13 are set to combine with the casing 12, binder is applied to attach a rubber ring 14 to the top rim of both the drum paper 1312 and the casing 12 for holding those parts together to ensure output quality of the speaker 1.

In the above described, at least one preferred embodiment has been described in detail with reference to the drawings annexed, and it is apparent that numerous variations or modifications may be made without departing from the true spirit and scope thereof, as set forth in the claims below.

What is claimed is:

1. A knockdown speaker comprising:

a magnetic circuit base, a casing, and a vibration unit, wherein the magnetic circuit base is substantially a hollow body having a projecting central cylinder and fixed at a top rim of the casing by a plurality of setting elements;

the vibration unit comprises a funnel-shaped cone socket and a damper set, which are formed by combining a bottom end and a top end of the vibration unit respectively with a sound ring set or a piece of drum paper;

whereby, after the magnetic circuit base and the casing have been put together, the sound ring set at the bottom end of the funnel-shaped cone socket can be plugged in the projecting central cylinder at the center of the magnetic circuit base such that the vibration unit can be coupled to the magnetic circuit base, and the vibration unit can be combined together with the casing to form an integral speaker by using a plurality of setting elements; and the casing comprises a plurality of stepping seats between the bottom end of the vibration unit and the magnetic circuit base, wherein the damper set rests on a bottom surface of one of the stepping seats.

2. The knockdown speaker as claimed in claim 1, wherein the setting element is a screw.

* * * * *